US006548412B2

(12) United States Patent
Fudoji et al.

(10) Patent No.: US 6,548,412 B2
(45) Date of Patent: Apr. 15, 2003

(54) METHOD OF FORMING PATTERNED THIN FILM

(75) Inventors: Hiroshi Fudoji, Tsukuba (JP); Mikihiko Kobayashi, Tsukuba (JP); Norio Shinya, Tsukuba (JP)

(73) Assignee: National Institute for Materials Science, Tsukuba (JP)

( * ) Notice: Subject to any disclaimer, the term of this patent is extended or adjusted under 35 U.S.C. 154(b) by 0 days.

(21) Appl. No.: 10/098,316

(22) Filed: Mar. 18, 2002

(65) Prior Publication Data

US 2002/0132498 A1 Sep. 19, 2002

(30) Foreign Application Priority Data

Mar. 19, 2001 (JP) ..... 2001-078498

(51) Int. Cl.[7] ..... H01L 21/311; B05D 7/00
(52) U.S. Cl. ..... 438/703; 427/486
(58) Field of Search ..... 427/458, 457, 427/466, 469, 472, 486; 438/703, 800

(56) References Cited

U.S. PATENT DOCUMENTS 6,391,217 B2 * 5/2002 Schaffer et al. ..... 216/41

OTHER PUBLICATIONS

Chou, Stephen; Zhuang, Lei; Guo, Linjie "Lithographic induced self–construction of polymer microstructures for resistless patterning." Applied Physics Letters, vol. 75, No. 7, pp. 1004–1006. Aug. 16, 1999.*

Service, Richard "Nanotechnology: Patterning Plastic with Plentiful Pillars" Science, vol. 286, No. 5442, p. 1067. Nov. 5, 1999 [(web, text version provided)].*

* cited by examiner

*Primary Examiner*—Carl Whitehead, Jr.
*Assistant Examiner*—Craig Thompson
(74) *Attorney, Agent, or Firm*—Kanesaka & Takeuchi

(57) ABSTRACT

A novel patterned thin film forming method is capable of realizing formation of nanometer-scale patterned thin films with high controllability by an easy and low-cost process. To form a patterned thin film on an insulating substrate in a precursor solution containing a film-forming substance, an electric charge pattern is formed on the insulating substrate, and then the insulating substrate is dipped in the precursor solution to deposit the film-forming substance on the electric charge pattern formed on the insulating substrate.

13 Claims, 8 Drawing Sheets

METHOD OF FORMING PATTERNED THIN FILM

BACKGROUND OF THE INVENTION

1. Field of the Invention

The present invention relates to a method of forming a patterned thin film. More particularly, the present invention provides a patterned thin film forming method useful for the manufacture of electronic devices such as storage devices, recording devices, microsensors, micromachines, and light-emitting devices. The method is capable of forming a patterned thin film on a substrate from such materials as ceramics and biopolymers, which have heretofore been difficult to form into patterned thin films by conventional vapor phase processes.

2. Discussion of Related Art

A large number of electronic ceramic devices are used as capacitors, resistors, varistors, etc. in compact electronic equipment such as those represented by portable telephones and mobile computers. It has been demanded that electronic ceramic devices should also be reduced in size and advance in function because of the progress of downsizing of electronic equipment.

Accordingly, many researchers in the world have extensively been proceeding with research and development making full use of lithography techniques to achieve finer ceramic thin film patterns constituting electronic ceramic devices to thereby realize higher integration. In these conventional processes, patterning is based on breakdown approach (see FIG. 9). That is, first, a desired thin film is formed on a substrate by a vapor phase method (partly by a liquid phase method). Thereafter, the thin film is patterned by etching.

For example, H. Krug reported a ceramic precursor thin-film pattern forming process utilizing a liquid phase (H. Krug, et. al., J. Non-crystalline Solids, 147&148, pp. 447–450, 1992). A photolithography process in which a precursor thin film formed on a substrate is exposed through a photomask is known. With this method, the resolution in the direction inside the thin film is limited by the wavelength of light used, because photolithography through a mask is used. Accordingly, the achievable patterning resolution is at the micrometer level at best. It is deemed extremely difficult to form a patterned thin film at the nanometer level.

Meanwhile, a technique based on built-up approach whereby molecules or ions are integrated on a substrate to form a nanometer-level pattern has been proposed, as opposed to the above-described breakdown approach. This is regarded as one of important assembling techniques, which is essential as an elemental technique in nanotechnology (see FIG. 10).

There are known thin-film pattern producing techniques using self-assembled monolayer (SAM) patterns as a template (B. C. Buker, et. al., Science, 264, pp. 48–55, 1994; Y. Xia, Ang. Chem. Int. Ed., 37, pp. 550–575, 1998). In these methods, SAM patterns of different properties are formed on a substrate. A nucleation and thin-film growth of precursor molecules preferentially occur on the SAM patterns owing to a difference in surface properties (hydrophilic nature and hydrophobic nature) in an aqueous solution. However, this method involves the problem that preprocessing for forming SAM patterns is complicated. In addition, there is a demand for improvements in the capability of controlling the deposition rate of precursor molecules at the nanometer level.

Methods of forming a patterned thin film under mild environmental conditions in a solution are known as "soft solution process" (Yoshimura, MRS Bulletin, 25, pp. 12–55, 2000 or "biomimetic process" (Koumoto, Kagaku Souran 42, pp. 83–93, 1999). These methods are expected to provide an environmentally friendly, ecological manufacturing process that belongs to a new field of researches and is technologically simple and easy as well as low-cost. Accordingly, the expansion of fundamental techniques for the method is expected.

SUMMARY OF THE INVENTION

The present invention was made in view of the above-described circumstances.

An object of the present invention is to provide a novel patterned thin film forming method capable of realizing formation of nanometer-scale patterned thin films with high controllability by an easy and low-cost process, thereby overcoming the disadvantages of the prior art. First, the present invention provides a method of forming a patterned thin film on an insulating substrate in a precursor solution containing a film-forming substance, which is characterized in that an electric charge pattern is formed on the insulating substrate, and then the insulating substrate is dipped in the precursor solution to deposit the film-forming substance on the electric charge pattern formed on the insulating substrate.

Secondly, the present invention provides a patterned thin film forming method characterized in that the insulating substrate is one selected from the group consisting of a silicon wafer, a glass, and a mica cleavage plane, each of which has a flat surface provided with a thermally oxidized film or an insulating dielectric film.

Thirdly, the present invention provides a patterned thin film forming method characterized in that the precursor solution containing a film-forming substance is one selected from the group consisting of a metal alkoxide, a metal acetyl acetate, and a metal carboxylate.

Fourthly, the present invention provides a patterned thin film forming method characterized in that a focused ion beam or a focused electron beam is applied to the surface of the insulating substrate to form an electric charge pattern in a non-contact manner.

Fifthly, the present invention provides a patterned thin film forming method characterized in that a metal probe or a microstamp is brought into contact with the surface of the insulating substrate to form an electric charge pattern.

Sixthly, the present invention provides a patterned thin film forming method characterized in that the rate of deposition of the film-forming substance on the electric charge pattern is adjusted by controlling the amount of electric charge carried by the electric charge pattern.

That is, the present invention provides the following patterned thin film forming methods.

(1) A method of forming a patterned thin film on an insulating substrate in a precursor solution containing a film-forming substance, which is characterized in that an electric charge pattern is formed on the insulating substrate, and then the insulating substrate is dipped in the precursor solution to deposit the film-forming substance on the electric charge pattern formed on the insulating substrate.

(2) A method of forming a patterned thin film on an insulating substrate in a precursor solution containing a film-forming substance, which is characterized in that an electric charge pattern is formed on the insulating substrate, which is one selected from the group consisting of a silicon wafer, a glass, and a mica cleavage plane, each of which has a flat surface provided with a thermally oxidized film or an insulating dielectric film, and then the insulating substrate is dipped in the precursor solution to deposit the film-forming substance on the electric charge pattern formed on the insulating substrate.

(3) A method of forming a patterned thin film on an insulating substrate in a precursor solution containing a film-forming substance, which is characterized in that an electric charge pattern is formed on the insulating substrate, and then the insulating substrate is dipped in the precursor solution containing the film-forming substance, which is one selected from the group consisting of a metal alkoxide, a metal acetyl acetate, and a metal carboxylate, to deposit the film-forming substance on the electric charge pattern formed on the insulating substrate.

(4) A method of forming a patterned thin film on an insulating substrate in a precursor solution containing a film-forming substance, which is characterized in that an electric charge pattern is formed on the insulating substrate, which is one selected from the group consisting of a silicon wafer, a glass, and a mica cleavage plane, each of which has a flat surface provided with a thermally oxidized film or an insulating dielectric film, and then the insulating substrate is dipped in the precursor solution containing the film-forming substance, which is one selected from the group consisting of a metal alkoxide, a metal acetyl acetate, and a metal carboxylate, to deposit the film-forming substance on the electric charge pattern formed on the insulating substrate.

(5) A method of forming a patterned thin film on an insulating substrate in a precursor solution containing a film-forming substance, which is characterized in that a focused ion beam or a focused electron beam is applied to the surface of the insulating substrate to form an electric charge pattern on the insulating substrate in a non-contact manner, and then the insulating substrate is dipped in the precursor solution to deposit the film-forming substance on the electric charge pattern formed on the insulating substrate.

(6) A method of forming a patterned thin film on an insulating substrate in a precursor solution containing a film-forming substance, which is characterized in that a focused ion beam or a focused electron beam is applied to the surface of the insulating substrate, which is one selected from the group consisting of a silicon wafer, a glass, and a mica cleavage plane, each of which has a flat surface provided with a thermally oxidized film or an insulating dielectric film, to form an electric charge pattern on the insulating substrate in a non-contact manner, and then the insulating substrate is dipped in the precursor solution to deposit the film-forming substance on the electric charge pattern formed on the insulating substrate.

(7) A method of forming a patterned thin film on an insulating substrate in a precursor solution containing a film-forming substance, which is characterized in that a focused ion beam or a focused electron beam is applied to the surface of the insulating substrate to form an electric charge pattern on the insulating substrate in a non-contact manner, and then the insulating substrate is dipped in the precursor solution containing the film-forming substance, which is one selected from the group consisting of a metal alkoxide, a metal acetyl acetate, and a metal carboxylate, to deposit the film-forming substance on the electric charge pattern formed on the insulating substrate.

(8) A method of forming a patterned thin film on an insulating substrate in a precursor solution containing a film-forming substance, which is characterized in that a focused ion beam or a focused electron beam is applied to the surface of the insulating substrate, which is one selected from the group consisting of a silicon wafer, a glass, and a mica cleavage plane, each of which has a flat surface provided with a thermally oxidized film or an insulating dielectric film, to form an electric charge pattern on the insulating substrate in a non-contact manner, and then the insulating substrate is dipped in the precursor solution containing the film-forming substance, which is one selected from the group consisting of a metal alkoxide, a metal acetyl acetate, and a metal carboxylate, to deposit the film-forming substance on the electric charge pattern formed on the insulating substrate.

(9) A method of forming a patterned thin film on an insulating substrate in a precursor solution containing a film-forming substance, which is characterized in that a metal probe or a microstamp is brought into contact with the surface of the insulating substrate to form an electric charge pattern on the insulating substrate, and then the insulating substrate is dipped in the precursor solution to deposit the film-forming substance on the electric charge pattern formed on the insulating substrate.

(10) A method of forming a patterned thin film on an insulating substrate in a precursor solution containing a film-forming substance, which is characterized in that a metal probe or a microstamp is brought into contact with the surface of the insulating substrate, which is one selected from the group consisting of a silicon wafer, a glass, and a mica cleavage plane, each of which has a flat surface provided with a thermally oxidized film or an insulating dielectric film, to form an electric charge pattern on the insulating substrate, and then the insulating substrate is dipped in the precursor solution to deposit the film-forming substance on the electric charge pattern formed on the insulating substrate.

(11) A method of forming a patterned thin film on an insulating substrate in a precursor solution containing a film-forming substance, which is characterized in that a metal probe or a microstamp is brought into contact with the surface of the insulating substrate to form an electric charge pattern on the insulating substrate, and then the insulating substrate is dipped in the precursor solution containing the film-forming substance, which is one selected from the group consisting of a metal alkoxide, a metal acetyl acetate, and a metal carboxylate, to deposit the film-forming substance on the electric charge pattern formed on the insulating substrate.

(12) A method of forming a patterned thin film on an insulating substrate in a precursor solution containing a film-forming substance, which is characterized in that a metal probe or a microstamp is brought into contact with the surface of the insulating substrate, which is one selected from the group consisting of a silicon wafer, a glass, and a mica cleavage plane, each of which has a flat surface provided with a thermally oxidized film or an insulating dielectric film, to form an electric charge pattern on the insulating substrate, and then the insulating substrate is dipped in the precursor solution containing the film-forming substance, which is one selected from the group consisting of a metal alkoxide, a metal acetyl acetate, and a metal carboxylate, to deposit the film-forming substance on the electric charge pattern formed on the insulating substrate.

(13) A method of forming a patterned thin film as stated in any of the above paragraphs (1) to (12), which is characterized in that the rate of deposition of the film-forming substance on the electric charge pattern is adjusted by controlling the amount of electric charge carried by the electric charge pattern.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

In the patterned thin film forming method according to the present invention, an electric charge pattern is formed on an insulating substrate, and the insulating substrate is put in a precursor solution containing a film-forming substance, whereby the film-forming substance is separated and deposited on the electric charge pattern by attraction force produced by the interaction between a nonuniform electric field formed by the electric charge pattern and the dipole moment induced in the film-forming substance ("Intermolecular Forces and Surface Forces", J. N. Israelachivili, Asakura Shoten, 1991, pp. 55–57, and pp. 59–63).

Various kinds of materials can be used as the insulating substrate. Above all, it is preferable to use one selected from the group consisting of a silicon wafer, a glass, and a mica cleavage plane, each of which has a surface flattened at the nanometer level and provided with a thermally oxidized film or an insulating dielectric film.

As the precursor solution containing a film-forming substance, for example, a metal alkoxide solution, a metal acetyl acetate or a metal carboxylate is used. It is a matter of course that the precursor solution is not necessarily limited to those mentioned above. It is possible to use any metal precursor solution using a nonpolar solvent, e.g. xylene or toluene. The concentration of the precursor solution is set in a range within which precipitation will not occur. In general, it is preferable to use a dilute precursor solution having a precursor concentration of not more than 1 mol %. If the precursor solution is at a high temperature during the formation of a patterned thin film, precipitation may occur. Therefore, it is preferable that the precursor solution should be handled at a low temperature in a range within which the precursor solution does not freeze. More specifically, it is preferable to handle the precursor solution at around room temperatures.

Figure 1:
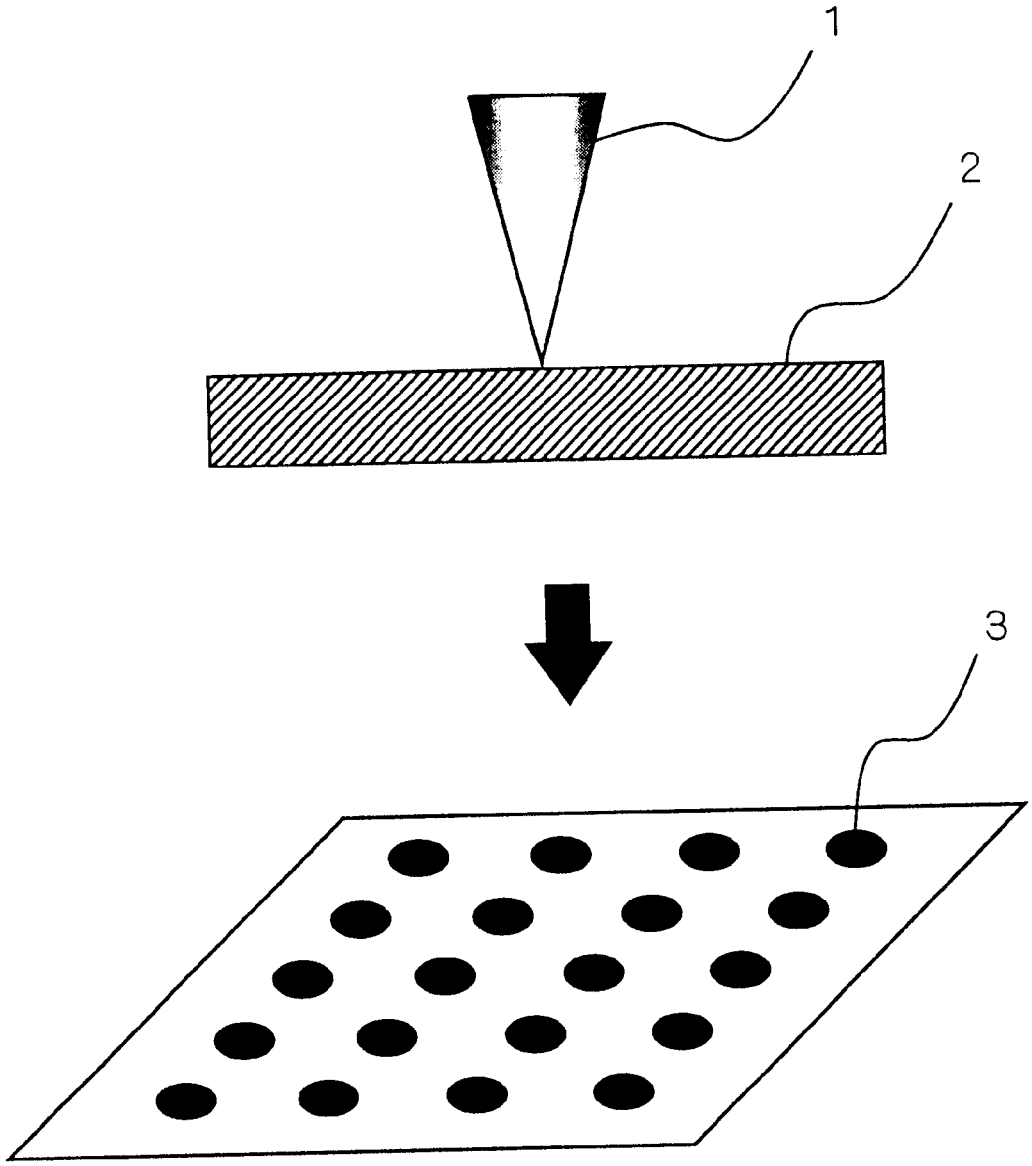
FIG. 1 is a schematic view showing an example of the method of forming an electric charge pattern according to the present invention.
Figure 2:
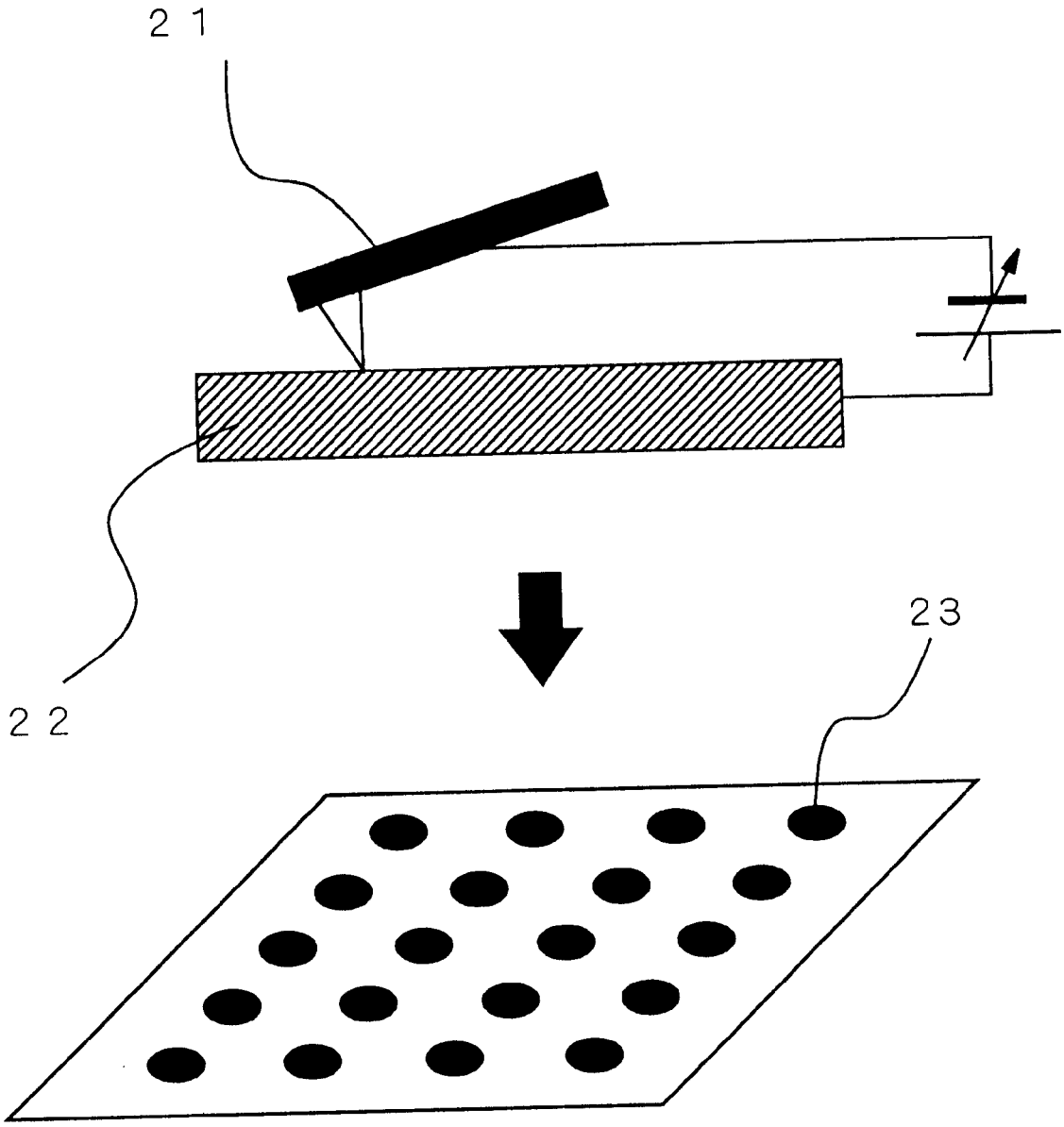
FIG. 2 is a schematic view showing another example of the method of forming an electric charge pattern according to the present invention.
Figure 3:
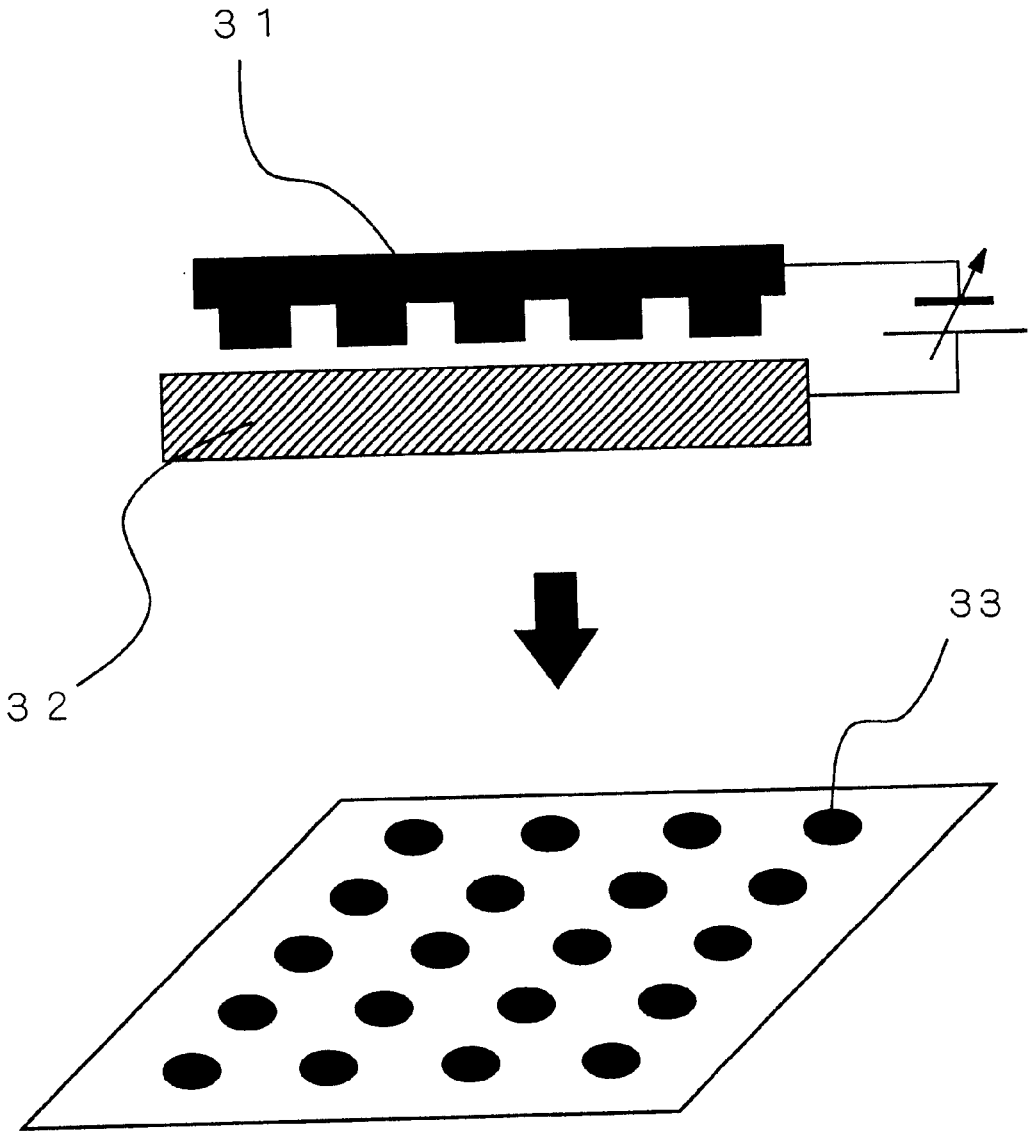
FIG. 3 is a schematic view showing another example of the method of forming an electric charge pattern according to the present invention.

The method of forming an electric charge pattern may be as follows. As shown in FIG. 1, a focused charged beam 1, e.g. a focused ion beam or a focused electron beam, is applied to the surface of an insulating substrate 2, and the focused charged beam 1 is scanned to form an electric charge pattern 3 in a non-contact manner. As shown in FIG. 2, a metal probe 21 may be used in place of the charged beam. In this case, a voltage is applied to the metal probe 21, and in this state, the metal probe 21 is scanned over an insulating substrate 22 to form an electric charge pattern 23. Similarly, as shown in FIG. 3, an electric charge pattern 33 may be formed by bringing an electrically-conductive microstamp 31 into contact with the surface of an insulating substrate 32 under application of a voltage to the microstamp 31.

If the amount of electric charge carried by the electric charge pattern is controlled during the formation thereof, it is possible to adjust the rate of deposition of the film-forming substance on the electric charge pattern as desired. The resolution of the pattern to be formed is equal to the resolution of the electric charge pattern. For example, with the method using a focused ion beam, a resolution of 10 nm or less can be realized when an existing focused ion beam lithography system is used.

In the patterned thin film forming method according to the present invention, a patterned thin film can be formed simply by dipping a flat insulating substrate formed with an electric charge pattern in a precursor solution without a particular need for preprocessing. After the film-forming substance has been deposited on the electric charge pattern, cleaning of the substrate is carried out, followed by heat treatment for removal of the organic matter and crystallization of the patterned thin film.

EXAMPLES

The present invention having the foregoing features will be described below more specifically with regard to examples.

Figure 4:
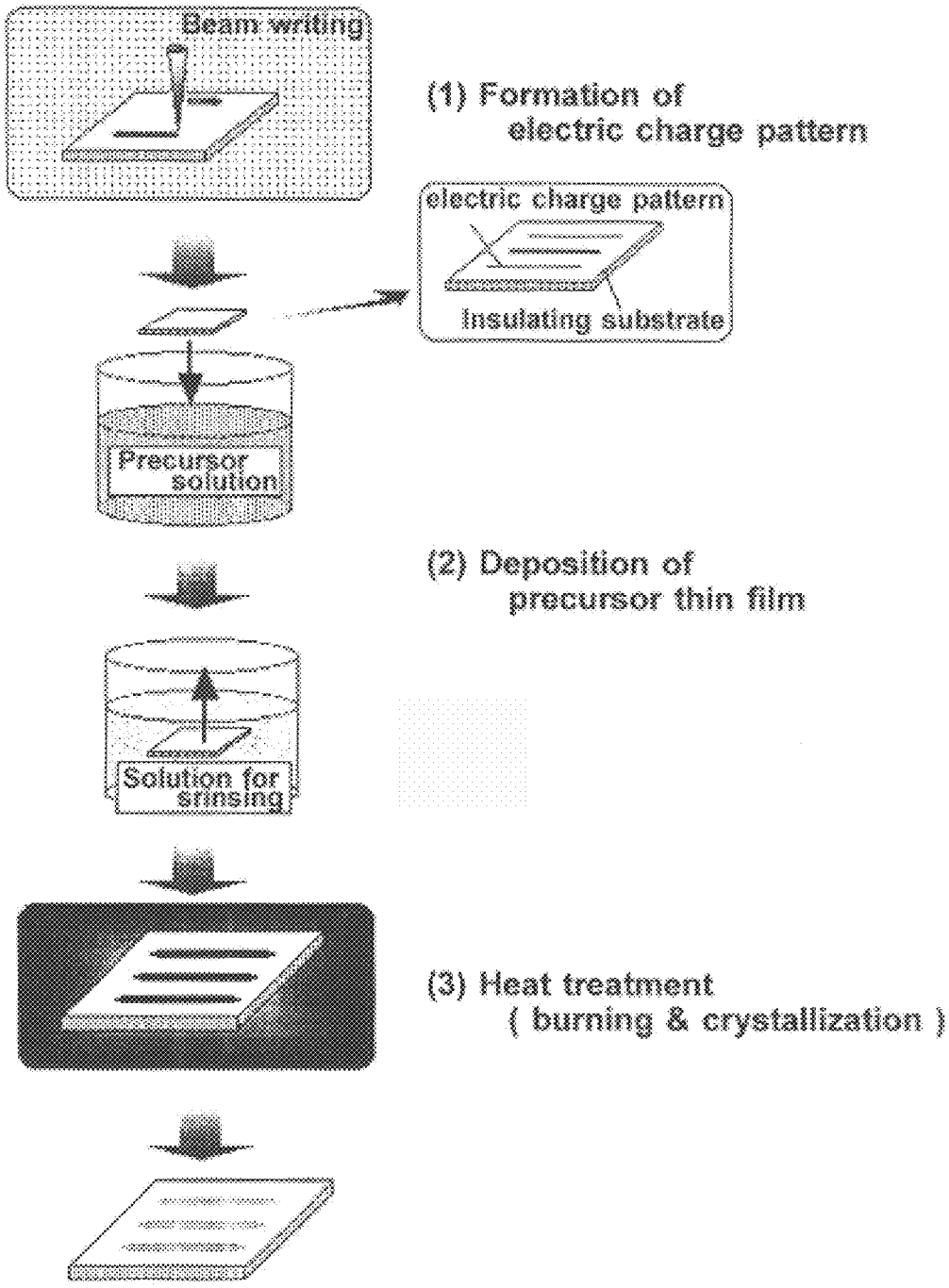
FIG. 4 is a schematic view showing the process of a patterned thin film forming method as an example of the present invention.

FIG. 4 is a schematic view showing the process of a patterned thin film forming method according to the present invention. As an example of the present invention, a Sr—Ti patterned thin film was formed on a $SiO_2$/Si wafer according to the process shown in FIG. 4 by way of example.

Figure 5:
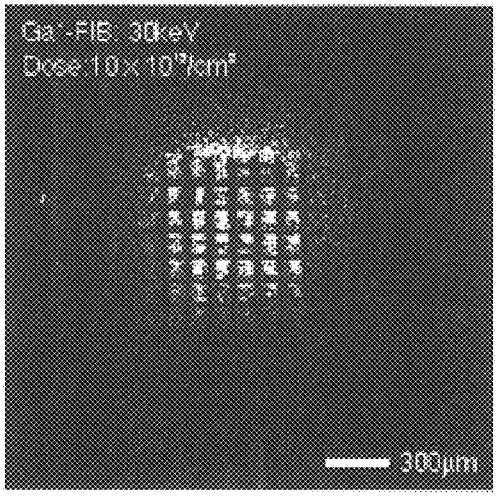
FIG. 5 is a diagram showing a secondary electron contrast image of an electric charge pattern formed in an example of the present invention.
Figure 6:
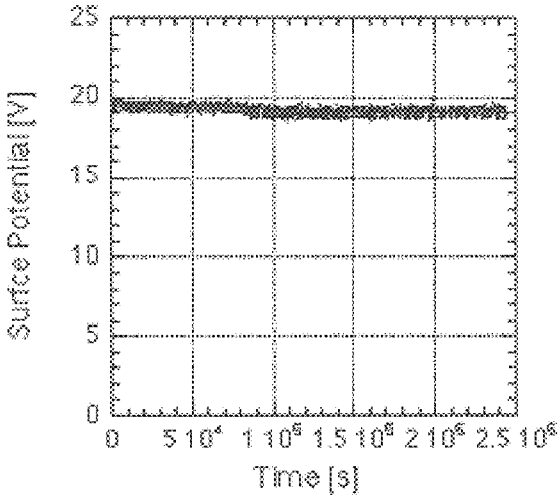
FIG. 6 is a graph showing the results of measurement of changes with time of the surface potential of an electric charge pattern formed on a $SiO_2$/Si wafer in an example of the present invention.

At a first step, an electric charge pattern was formed on a $SiO_2$/Si wafer by using a $Ga^+$ focused ion beam at an acceleration voltage of 30 kV. FIG. 5 shows a secondary electron contrast image of the electric charge pattern formed in this way. FIG. 6 is a graph showing the results of measurement of changes with time of the surface potential of the $SiO_2$/Si wafer. It will be understood from FIG. 6 that the surface of the $SiO_2$/Si wafer carries stable electrical charges of positive polarity showing minimum changes with time.

At a second step, the $SiO_2$/Si wafer formed with the electric charge pattern was dipped in a ceramic precursor solution (EMOD-Sr xylene solution and EMOD-Ti xylene solution; mixing ratio: 1:1) for 12 hours at room temperature, thereby forming a patterned thin film on the electric charge pattern. Thereafter, the substrate was rinsed with xylene to wash the excess solution off the substrate. It should be noted that EMOD-Sr and EMOD-Ti are alkoxide metals (U.S. Pat. No. 6,174,564) available from Symetrix Corporation, U.S.A.

At a third step, the $SiO_2$/Si wafer having the ceramic precursor deposited thereon as a patterned thin film was heat-treated in the atmosphere, thereby burning the organic matter contained in the ceramic precursor and, at the same time, crystallizing the patterned thin film. It is known that the process carried out at the third step allows the deposited precursor to be crystallized into a ceramic thin film at a relatively low temperature (Introduction to Sol-Gel Processing, Alain C. Pierre, Kluwer Academic pub., 1998). When taken out into the atmosphere, the alkoxide metal molecules M—OR (M is Sr or Ti; R is an alkane group) deposited on the substrate as a pattern at the second step undergo hydrolysis exhibiting the following reaction:

$$M—OR+H_2O \rightarrow M—OH+H—OR$$

Further, the heat treatment causes the following reaction to take place to form a ceramic thin film:

M—OH (hydrate)→MO (oxide)

Figure 7:
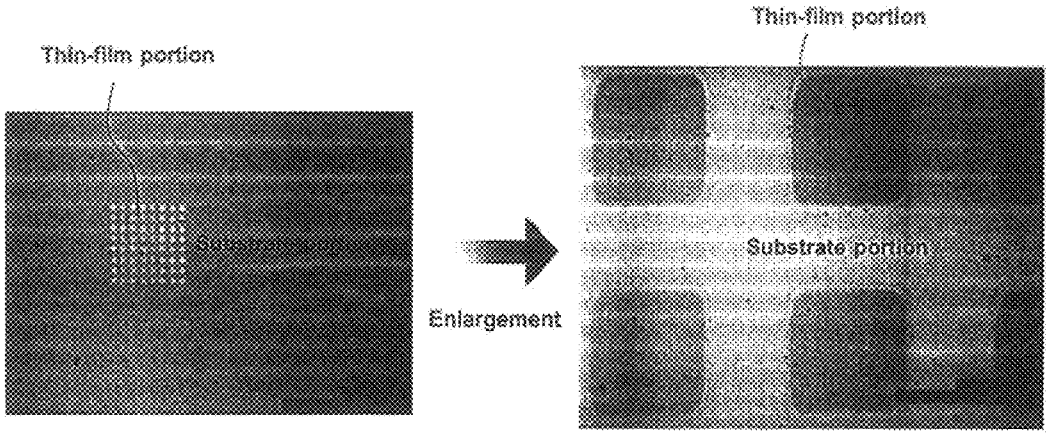
FIG. 7 is a diagram showing images of a patterned thin film formed on a $SiO_2$/Si wafer, which are observed through a scanning confocal laser microscope, in an example of the present invention.

FIG. 7 shows an image of the patterned thin film formed on the $SiO_2$/Si wafer observed through a scanning confocal laser microscope. It will be understood from FIG. 7 that a square lattice pattern, each side of which has a length of 25 $\mu$m, is formed with a film thickness of less than several hundred nanometers in a region on the $SiO_2$/Si wafer.

Figure 8:
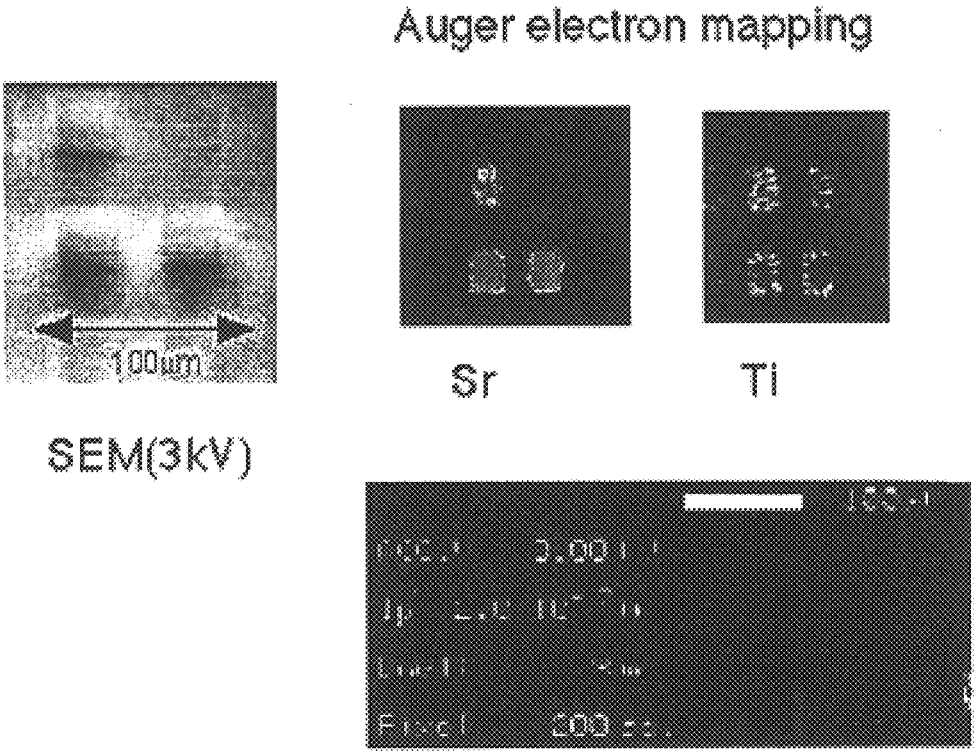
FIG. 8 is a diagram showing a secondary electron image of a patterned thin film, together with mapping images of the Sr element and the Ti element corresponding thereto, in an example of the present invention.
Figure 9:
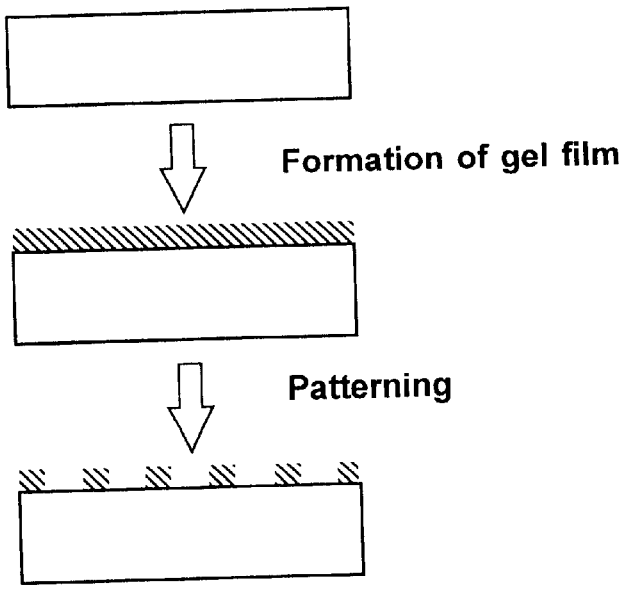
FIG. 9 is a schematic view showing patterning based on breakdown approach.
Figure 10:
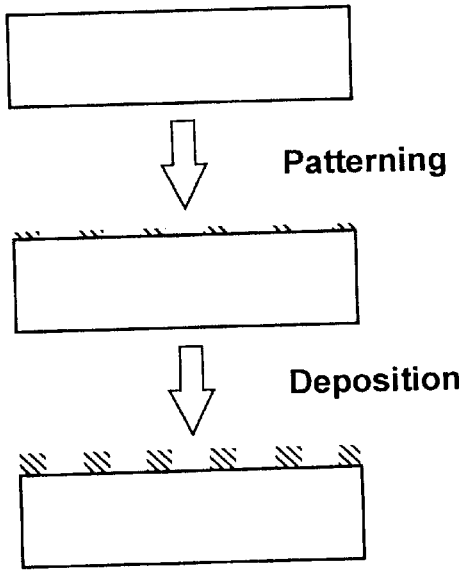
FIG. 10 is a schematic view showing patterning based on built-up approach.

FIG. 8 shows a secondary electron image of the patterned thin film, together with mapping images of the Sr element and the Ti element corresponding thereto. Thus, it has been confirmed that Sr and Ti are present in the region where the patterned thin film is present.

In the example shown above, the exact thickness of the patterned thin film was not known. However, it is considered that a patterned thin film with a thickness of less than several hundred nanometers was formed because the resolution of the confocal laser microscope in terms of height was not more than 0.2 $\mu$m. Meanwhile, the resolution of the patterned thin film in the horizontal direction of the surface thereof depends on the resolution of the electric charge pattern. That is, it is determined by the spot size of the $Ga^+$focused ion beam during writing. The minimum spot size realized with the latest-type focused ion beam lithography system (e.g. SMI9800, manufactured by Seiko Instrument Inc.) is several nanometers. Therefore, it is deemed possible to form a pattern of the order of 10 nanometers in size in the horizontal direction of the surface of the patterned thin film.

As has been detailed above, the present invention provides a novel patterned thin film forming method capable of realizing formation of nanometer-scale patterned thin films by an easy and low-cost process.

According to the present invention, a great variety of patterned films can be formed without a particular restriction on the kind of precursor molecules to be deposited. Therefore, the patterned thin film forming method of the present invention is expected to be used in a wide range of applications. The patterned thin film forming method of the present invention comprises an easy and simple process utilizing a liquid phase and exhibits very high economy and general versatility. Therefore, the patterned thin film forming method of the present invention can be readily substituted for the prior art. Thus, it is expected that the present invention will be used in various fields.

What is claimed is:

1. A method of forming a patterned thin film on an insulating substrate in a precursor solution containing a film-forming substance, said method comprising the steps of:

forming an electric charge pattern on the insulating substrate; and dipping said insulating substrate in the precursor solution to deposit the film-forming substance on the electric charge pattern formed on said insulating substrate.

2. A method of forming a patterned thin film on an insulating substrate in a precursor solution containing a film-forming substance, said method comprising the steps of:

forming an electric charge pattern on the insulating substrate, which is one selected from the group consisting of a silicon wafer, a glass, and a mica cleavage plane, each of which has a flat surface provided with a thermally oxidized film or an insulating dielectric film; and dipping said insulating substrate in the precursor solution to deposit the film-forming substance on the electric charge pattern formed on said insulating substrate.

3. A method of forming a patterned thin film on an insulating substrate in a precursor solution containing a film-forming substance, said method comprising the steps of:

forming an electric charge pattern on the insulating substrate; and dipping said insulating substrate in the precursor solution containing the film-forming substance, which is one selected from the group consisting of a metal alkoxide, a metal acetyl acetate, and a metal carboxylate, to deposit the film-forming substance on the electric charge pattern formed on said insulating substrate.

4. A method of forming a patterned thin film on an insulating substrate in a precursor solution containing a film-forming substance, said method comprising the steps of:

forming an electric charge pattern on the insulating substrate, which is one selected from the group consisting of a silicon wafer, a glass, and a mica cleavage plane, each of which has a flat surface provided with a thermally oxidized film or an insulating dielectric film; and dipping said insulating substrate in the precursor solution containing the film-forming substance, which is one selected from the group consisting of a metal alkoxide, a metal acetyl acetate, and a metal carboxylate, to deposit the film-forming substance on the electric charge pattern formed on said insulating substrate.

5. A method of forming a patterned thin film on an insulating substrate in a precursor solution containing a film-forming substance, said method comprising the steps of:

applying a focused ion beam or a focused electron beam to a surface of the insulating substrate to form an electric charge pattern on said insulating substrate in a non-contact manner; and dipping said insulating substrate in the precursor solution to deposit the film-forming substance on the electric charge pattern formed on said insulating substrate.

6. A method of forming a patterned thin film on an insulating substrate in a precursor solution containing a film-forming substance, said method comprising the steps of:

applying a focused ion beam or a focused electron beam to a surface of the insulating substrate, which is one selected from the group consisting of a silicon wafer, a glass, and a mica cleavage plane, each of which has a flat surface provided with a thermally oxidized film or an insulating dielectric film, to form an electric charge pattern on said insulating substrate in a non-contact manner; and dipping said insulating substrate in the precursor solution to deposit the film-forming substance on the electric charge pattern formed on said insulating substrate.

7. A method of forming a patterned thin film on an insulating substrate in a precursor solution containing a film-forming substance, said method comprising the steps of:

applying a focused ion beam or a focused electron beam to a surface of the insulating substrate to form an electric charge pattern on said insulating substrate in a non-contact manner; and dipping said insulating substrate in the precursor solution containing the film-forming substance, which is one selected from the group consisting of a metal alkoxide, a metal acetyl acetate, and a metal carboxylate, to deposit the film-forming substance on the electric charge pattern formed on said insulating substrate.

8. A method of forming a patterned thin film on an insulating substrate in a precursor solution containing a film-forming substance, said method comprising the steps of:

applying a focused ion beam or a focused electron beam to a surface of the insulating substrate, which is one selected from the group consisting of a silicon wafer, a glass, and a mica cleavage plane, each of which has a flat surface provided with a thermally oxidized film or an insulating dielectric film, to form an electric charge pattern on said insulating substrate in a non-contact manner; and dipping said insulating substrate in the precursor solution containing the film-forming substance, which is one selected from the group consisting of a metal alkoxide, a metal acetyl acetate, and a metal carboxylate, to deposit the film-forming substance on the electric charge pattern formed on said insulating substrate.

9. A method of forming a patterned thin film on an insulating substrate in a precursor solution containing a film-forming substance, said method comprising the steps of:

bringing one of a metal probe and a microstamp into contact with a surface of the insulating substrate to form an electric charge pattern on said insulating substrate; and dipping said insulating substrate in the precursor solution to deposit the film-forming substance on the electric charge pattern formed on said insulating substrate.

10. A method of forming a patterned thin film on an insulating substrate in a precursor solution containing a film-forming substance, said method comprising the steps of:

bringing one of a metal probe and a microstamp into contact with a surface of the insulating substrate, which is one selected from the group consisting of a silicon wafer, a glass, and a mica cleavage plane, each of which has a flat surface provided with a thermally oxidized film or an insulating dielectric film, to form an electric charge pattern on said insulating substrate; and dipping said insulating substrate in the precursor solution to deposit the film-forming substance on the electric charge pattern formed on said insulating substrate.

11. A method of forming a patterned thin film on an insulating substrate in a precursor solution containing a film-forming substance, said method comprising the steps of:

bringing one of a metal probe and a microstamp into contact with a surface of the insulating substrate to form an electric charge pattern on said insulating substrate; and dipping said insulating substrate in the precursor solution containing the film-forming substance, which is one selected from the group consisting of a metal alkoxide, a metal acetyl acetate, and a metal carboxylate, to deposit the film-forming substance on the electric charge pattern formed on said insulating substrate.

12. A method of forming a patterned thin film on an insulating substrate in a precursor solution containing a film-forming substance, said method comprising the steps of:

bringing one of a metal probe and a microstamp into contact with a surface of the insulating substrate, which is one selected from the group consisting of a silicon wafer, a glass, and a mica cleavage plane, each of which has a flat surface provided with a thermally oxidized film or an insulating dielectric film, to form an electric charge pattern on said insulating substrate; and dipping said insulating substrate in the precursor solution containing the film-forming substance, which is one selected from the group consisting of a metal alkoxide, a metal acetyl acetate, and a metal carboxylate, to deposit the film-forming substance on the electric charge pattern formed on said insulating substrate.

13. A method of forming a patterned thin film according to claim 1, wherein a rate of deposition of the film-forming substance on the electric charge pattern is adjusted by controlling an amount of electric charge carried by the electric charge pattern.

* * * * *